United States Patent [19]

Billman et al.

[11] Patent Number: 4,973,270

[45] Date of Patent: Nov. 27, 1990

[54] CIRCUIT PANEL SOCKET WITH CLOVERLEAF CONTACT

[75] Inventors: Timothy B. Billman, King; Roger L. Thrush, Clemmons, both of N.C.

[73] Assignee: AMP Incorporated, Harrisburg, Pa.

[21] Appl. No.: 520,144

[22] Filed: May 4, 1990

Related U.S. Application Data

[63] Continuation of Ser. No. 360,644, Jun. 2, 1989, abandoned.

[51] Int. Cl.[5] ..... H01R 9/09

[52] U.S. Cl. ..... 439/630

[58] Field of Search ..... 439/629–637

[56] References Cited

U.S. PATENT DOCUMENTS

| | | | |
|---|---|---|---|
| 3,246,279 | 4/1966 | Storcel | 339/17 |
| 3,289,146 | 11/1966 | Tuchel | 439/630 |
| 4,548,456 | 10/1985 | Robertson | 439/631 |
| 4,557,548 | 12/1985 | Thrush | 339/258 P |
| 4,558,912 | 12/1985 | Coller | 339/64 M |
| 4,575,172 | 3/1986 | Walse et al. | 439/631 |
| 4,634,210 | 1/1987 | Crawford | 439/630 |
| 4,725,250 | 2/1988 | Kuhn et al. | 439/629 |
| 4,737,120 | 4/1988 | Grabbe et al. | 439/326 |
| 4,781,612 | 11/1988 | Thrush | 439/328 |
| 4,826,446 | 5/1989 | Juntwait | 439/326 |
| 4,850,891 | 7/1989 | Walkup et al. | 439/326 |
| 4,850,892 | 7/1989 | Clayton et al. | 439/326 |

*Primary Examiner*—Joseph H. McGlynn

*Attorney, Agent, or Firm*—Robert W. Pitts; Allan B. Osborne

[57] ABSTRACT

A single in-line memory module socket employing edge stamped contacts positioned within an insulative housing is disclosed. Each terminal has opposed beams with a loop section intermediate the ends of upwardly extending portions of those beams. Inwardly inclined arms extend downwardly from the top of the opposed beams and the contacts are configured so that majority of the deflection of the beams occurs in these inwardly inclined arms. A central post extends upwardly from the base of the terminals and engages housing ribs located within a central spine located along the bottom of a panel receiving slot in the insulative housing. Cavities intersect the slots receiving the circuit panels and the terminals can be inserted into the respective cavities from the bottom, with the posts extending upwardly from the base securing the terminals by engagement with the central spine. Panel support guides extend upwardly at either end of the housing and ridges on flexible walls in the housing stabilize the modules in the sockets.

25 Claims, 6 Drawing Sheets

CIRCUIT PANEL SOCKET WITH CLOVERLEAF CONTACT

This application is a continuation of application Ser. No. 07/360,644 filed June 2, 1989, now abandoned.

BACKGROUND OF THE INVENTION

1. Field of the Invention

This application relates to an electrical connector and a terminal for use in the electrical connector of the type suitable for use in establishing an interconnector to traces on a circuit panel, especially to an electrical connector socket for use in establishing electrical interconnections to a single in-line memory module.

2. Description of the Prior Art

Single in-line memory modules represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

One approach for mounting single in-line memory modules on a daughterboard would be to employ plug in leads adjacent one edge of the circuit panel. These plug in leads can then be connected to conventional printed circuit board contacts such as miniature spring contacts.

An alternate approach has been to use single in-line memory module sockets to establish a disconnectable interconnection to traces along the edge of the circuit panel used in the single in-line memory module. Terminals for use in such sockets are disclosed in U.S. Pat. Nos. 4,557,548 and 4,558,912. Additional details of an insulative housing which is suitable for use with those terminals is disclosed in U.S. Pat. 4,781,612. The socket disclosed in these patents is intended for use with in-line memory modules having a center line spacing for pads or traces at the edge of the circuit panel of 0.100 inch. Since the terminals employed in that socket are stamped and formed, the width of the terminals generally precludes establishing an interconnection on closer center line spacings.

Instead of using stamped and formed terminals, other single in-line memory module sockets employ edge stamped terminals. For example, U.S. Pat. No. 4,737,120 discloses an electrical connector of the type suitable for use in a single in-line memory module in which a zero insertion force interconnection is established between the terminals and the pads on the circuit panel. The circuit panel is inserted at a angle and then cammed into position. The insulative housing on the connector provides a stop to hold the circuit panel in position. Another zero insertion force connector is disclosed in U.S. Pat. No. 4,575,172. The contact terminals in each of these patents is edge stamped sockets using terminals of this type are suitable for use on center line spacings on the order of 0.050 inches.

Each of these zero insertion force configurations provides limited wipe between the contacts and the pads on the printed circuit board. It is understood that full force wipe is desirable in order to remove contaminates which may build up either on the terminals or on the printed circuit board pads or traces. U.S. Pat. No. 4,725,250 discloses a socket connector employing a terminal in which a full force wiping action is established between the terminals and the surface pad portions of traces on the circuit panel. This connector also includes edged stamped terminals. The connector shown in U.S. Pat. No. 4,725,250 is suitable for use with standard single in-line memory modules. However, not all commercially available single in-line memory modules are manufactured in compliance with generally accepted standards for such modules, such as appropriate JEDEC standards. Nonstandard single in-line memory module circuit panels are manufactured with the pad portions of the traces adjacent the edge of the circuit panel being shorter than required by industry acknowledged standards. The connector disclosed in U.S. Pat. No. 4,725,250 is unsuitable for use with circuit panels having short pad portions where contact must be established immediately adjacent the edge of the circuit panel because of the height of the beams used to establish the full force wipe contact in that connector.

Deviations in JEDEC standards have also occurred because some module manufacturers have been unable to maintain a tolerance of $\pm 0.003$ inches on the module thickness as required by JEDEC. Tolerances of $\pm 0.008$ inches are more realistic; but such tolerances complicate the design of the terminal because a larger deflection range is necessary. Lengthening the terminals is not suitable because the improved density offered by SIMM's is compromised and contact cannot be established adjacent the edge of the module.

Not only have non-conforming single in-line memory modules begun to appear, but the basic single in-line memory module socket is being adapted to applications in which additional integrated circuit components are positioned on the circuit panel. Indeed the height of the circuit panel has been increasing as more and more integrated circuit packages are added to the modules. Modules referred to as SAM's (special application modules) using the basic SIMM approach. For instance, boards using the SIMM approach now have a height of 2.0 to 3.5 inches. The additional height of these circuit panels, makes it difficult for standard sockets to stabilize these components since conventional panel guides used in such sockets do not have a height sufficient to engage these circuit panels adjacent there upper end. The instant invention provides not only a means for stabilizing circuit panels having a greater height, but also employs a terminal suitable for establishing electrical contact adjacent the edge of the circuit panels so that this full force wipe connector can be employed with non-standard single in-line memory module circuit panels.

SUMMARY OF THE INVENTION

An electrical connector or socket suitable for use in establishing electrical contact with the edge of traces on at least one side of a circuit panel, such as a single in-line memory module, is disclosed. The connector includes a plurality of terminals mounted in an insulative housing. Terminals are edge stamped from a spring metal blank, so that the connector can achieve close center line spacings. Each terminal has opposed beams extending upwardly from a base. The beams are deflectable upon insertion of a circuit panel therebetween. Each beam has an upwardly extending portion with a loop section intermediate the ends. The downwardly extending portion of the beam, located on the interior of the upwardly extending portion, includes a contact section adjacent the end of the downwardly extending portion. The terminals are positioned within an insulative housing having at least one upwardly open slot into which the circuit panels are inserted. A plurality of cavities are located along the slot, on either side of the slot. The terminals are positioned within the housing cavities with the contact point on each downwardly extending arm of the contacts extending into the circuit panel receiving slot. In the preferred embodiment, the terminals are inserted into the housing from the lower surface. Each terminal includes a upwardly extending post or barb which can be secured within a central spine and secures the terminals in position within the housing and provides a stop against which the edge of the circuit panel will abut if the circuit panel is inserted too far into the panel receiving slot.

DETAILED DESCRIPTION OF THE PREFERRED EMBODIMENT

Figure 1:
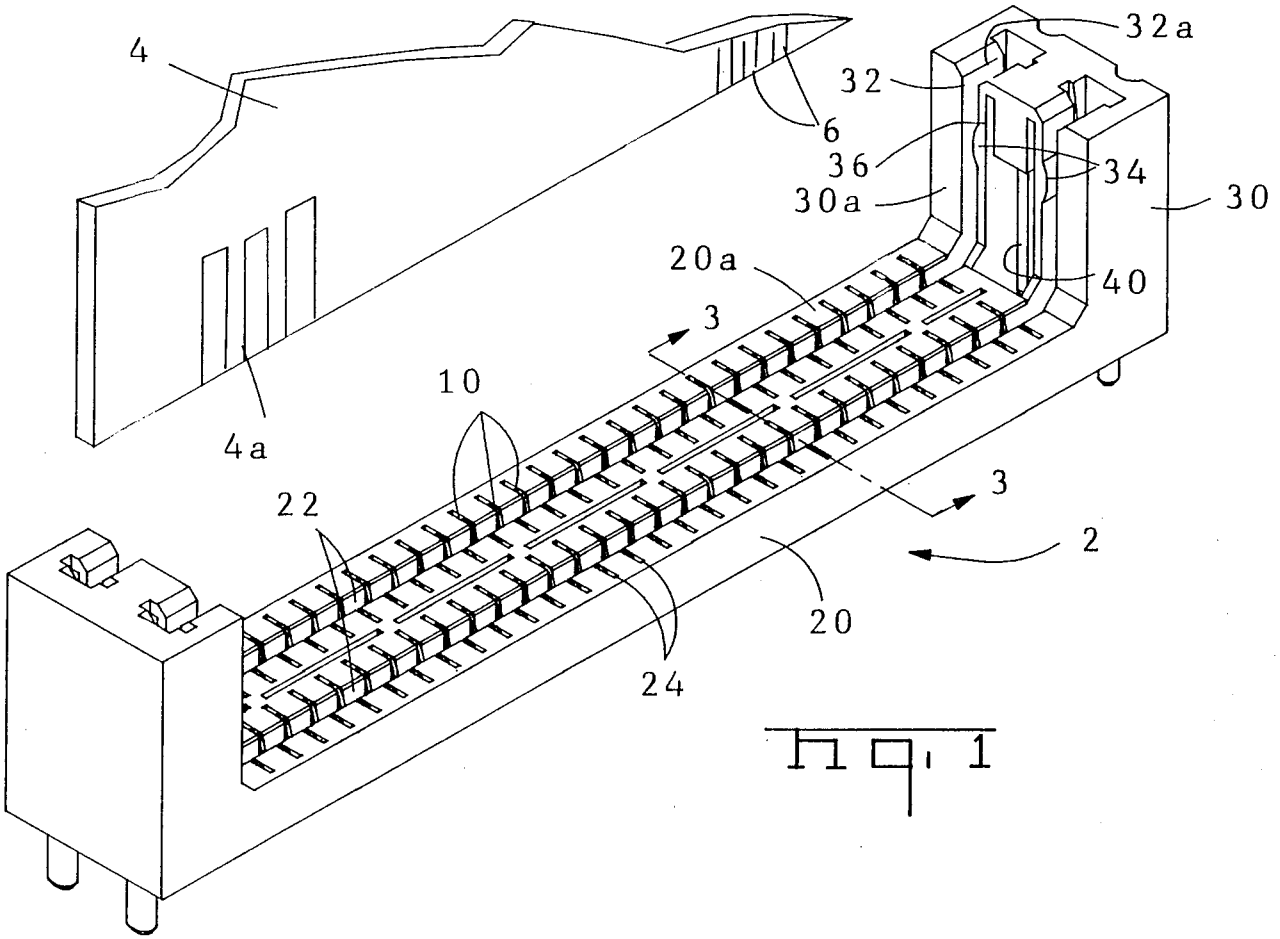
FIG. 1 is a perspective view of the socket comprising the preferred embodiment of this invention to the edge of a circuit panel of a single in-line memory module shown exploded above a panel receiving slot.

Single in-line memory module socket or connector 2 employs a plurality of terminals 10 positioned within an insulative housing 20 to establish contact with traces 6 on a circuit panel 4 adjacent one edge 4*a* of the circuit panel. This connector 2 is suitable for use with a circuit panel 4 having traces in which the center line spacing of that portion of the trace 6 adjacent the edge 4*a* of the circuit panel being spaced from the next adjacent terminal on center line spacings of 0.050 inches. The terminals 10 are edge stamped from a spring metal blank and are formed of a material such as beryllium copper or of phosphor bronze. Each terminal 10 is suitable for establishing an electrical contact with traces on at least one side of the circuit panel adjacent the edge of the traces.

Each terminal 10 has opposed beams 12 extending upwardly from a base 14. A post or barb 16 extends upwardly from the center of the base 14 between the opposed beams. A contact tail 18, aligned with the post or barb 16 extends from the bottom of the base and is suitable for establishing an electrical interconnection with a printed circuit board on which the socket 2 can be mounted.

Figure 2:
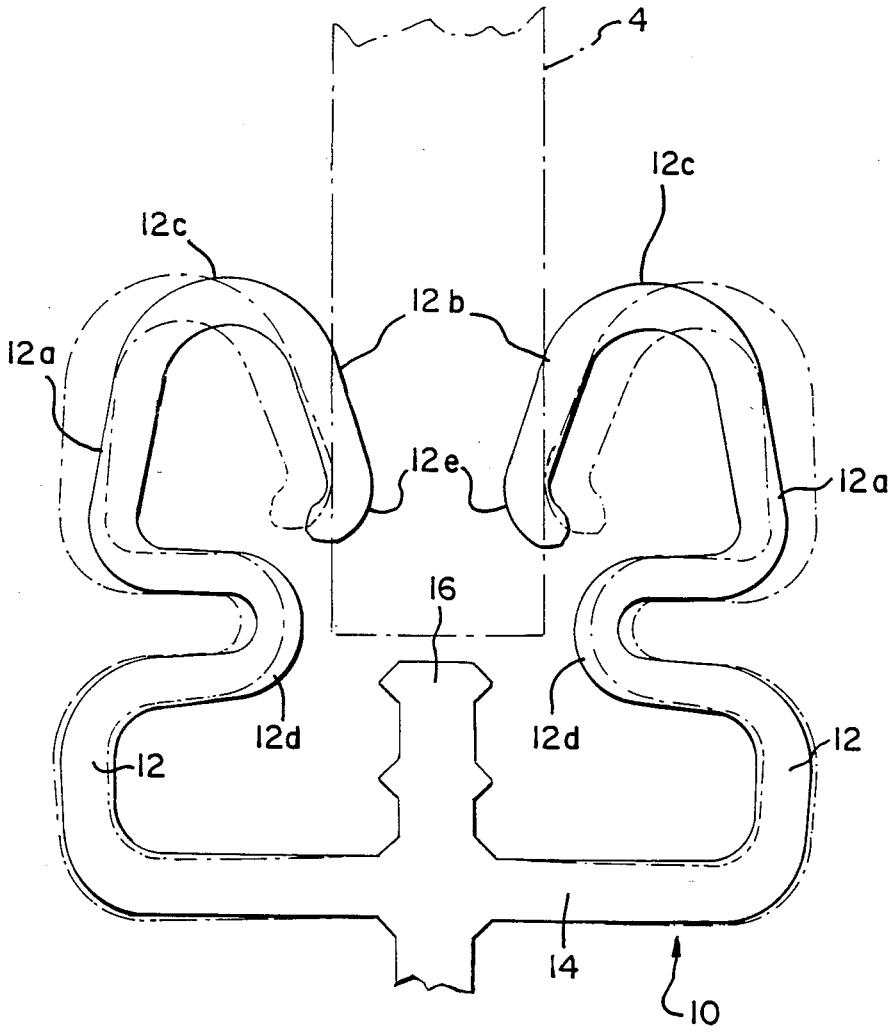
FIG. 2 is a view of a terminal used in this socket, showing the deflection as determined by finite element analysis of the terminal (in phantom) when a circuit panel is inserted between the opposed beams.
Figure 3:
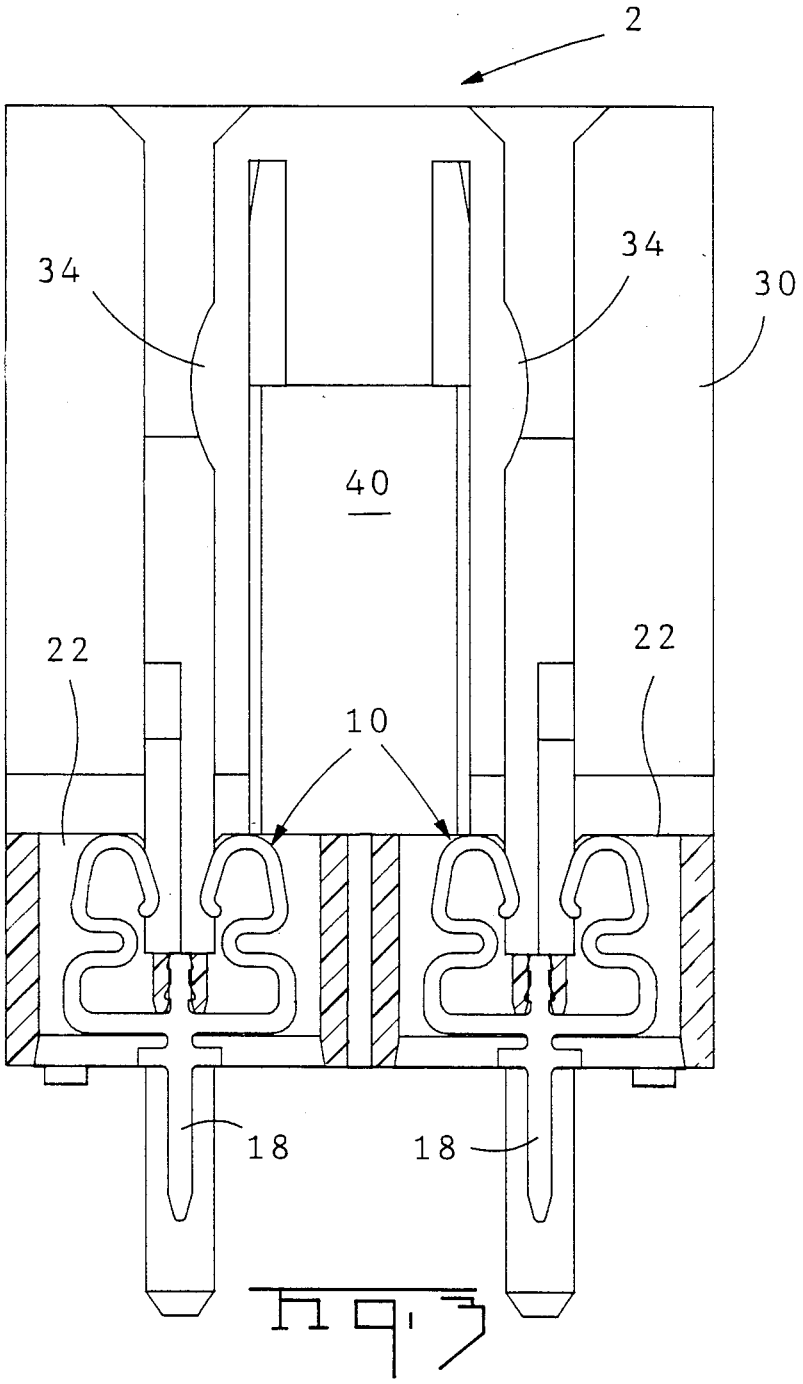
FIG. 3 is a sectional view taken along section lines 3—3 in FIG. 1 showing the position of the terminals within the housing and showing the interface of one panel support member located at the end of the housing.
Figure 4:
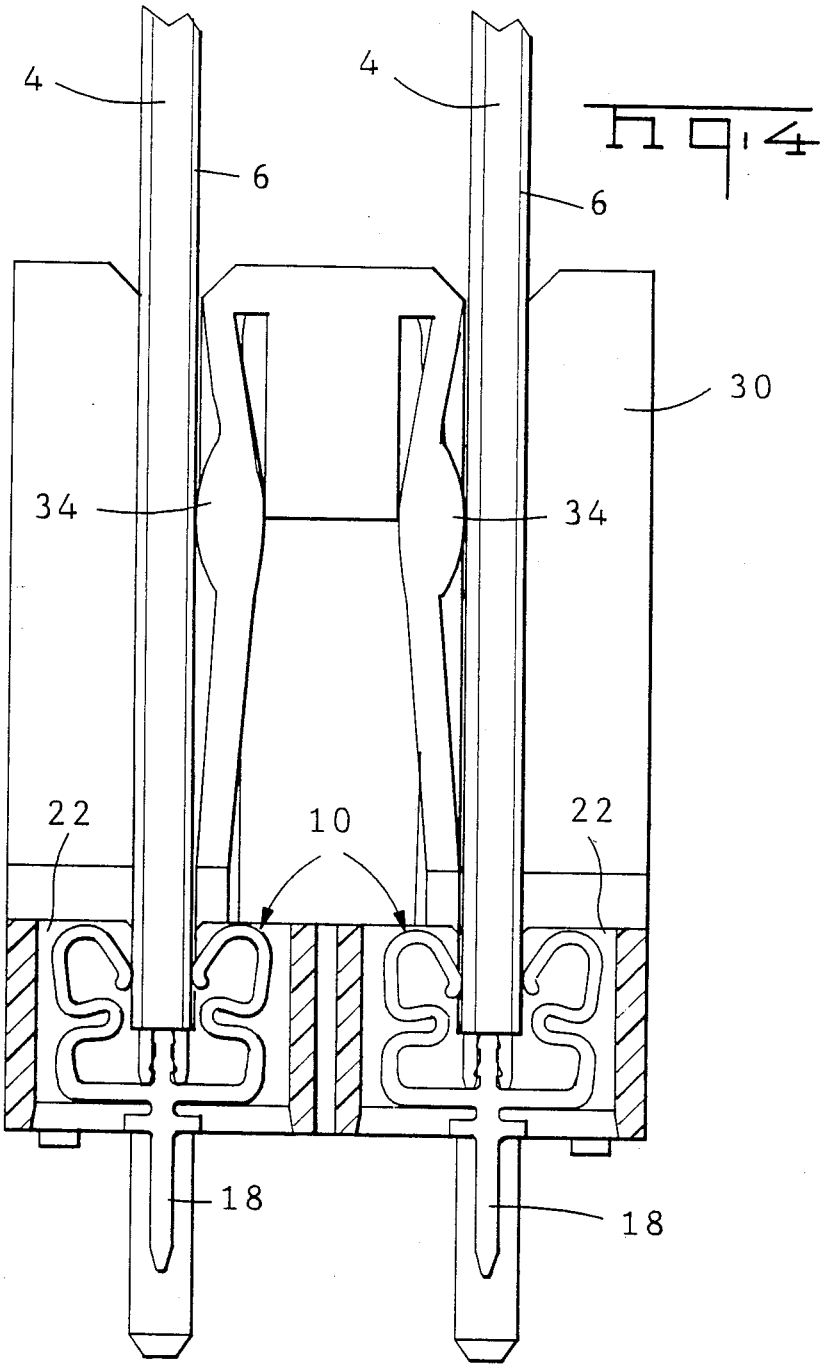
FIG. 4 is a view similar to FIG. 3 showing two circuit panels inserted into engagement with terminals and showing the deflection of flexible walls in the panel support member for stabilizing the printed circuit panels.

The opposed beams 12 are deflectable upon insertion of a circuit panel 4 between the beams. Each of the beams 12 comprises an upwardly extending portion, extending from one end of the base 14 which extends between the two opposed beams 12. The upwardly extending portion 12*a* is connected to the base 14 and is inclined inwardly. Inwardly inclined arms 12*b* extend downwardly from the top 12*c* of the upwardly extending portion. These inwardly inclined arms 12*b* diverge from the inwardly inclined portion of the upwardly extending portion 12*a*. An inwardly extending loop section 12*d* is located between the top and the bottom of the upwardly extending portion 12*a* of each of the opposed beams 12. In the preferred embodiment of the terminal, that portion of the beams between the base 14 and the loop sections 12*d* is tapered. The elevation of inwardly extending loop section 12*d* is such that it is located between the base 14 and the end of the downwardly extending portion 12*b*. Indeed, the inwardly extending loop 12*d* is located below the downwardly extending portion 12*b* in the preferred embodiment of this invention. The inwardly extending loop section 12*d* is a generally U shaped member in which the bight of the loop section 12*c* is located along the inner edge of the opposed beams 12 with the open portion of the U-shaped loop facing outward. The two parallel sides of the U shaped loop section 12*c* are generally parallel to the base 14 and the bight is generally curved. A contact point 12*e* is located at the innermost extent of the downwardly extending portion 12*b* and the contact point 12*e* is located adjacent the end of each beam 12. The contact 12*e* is located above the loop section 12*d*. As shown in FIG. 2, the opposed beams 12 are configured such that the majority of the flexure of the opposed beams 12 in the loop section 12*d*, the base 14 and in that portion of the terminal between the base and the loop. A relatively large deflection of the contact point 12*e* can be achieved without increasing the height of the beams 12.

Post 16, which comprises a barb, extends upwardly from the base 14 between the two opposed beams 12. Indeed, post 16 is located between the two contact points 12*e* on opposed beams 12. The elevation of the upper surface of post 16 is such that it is substantially at the same elevation as the loop section 12*c*.

Figure 5:
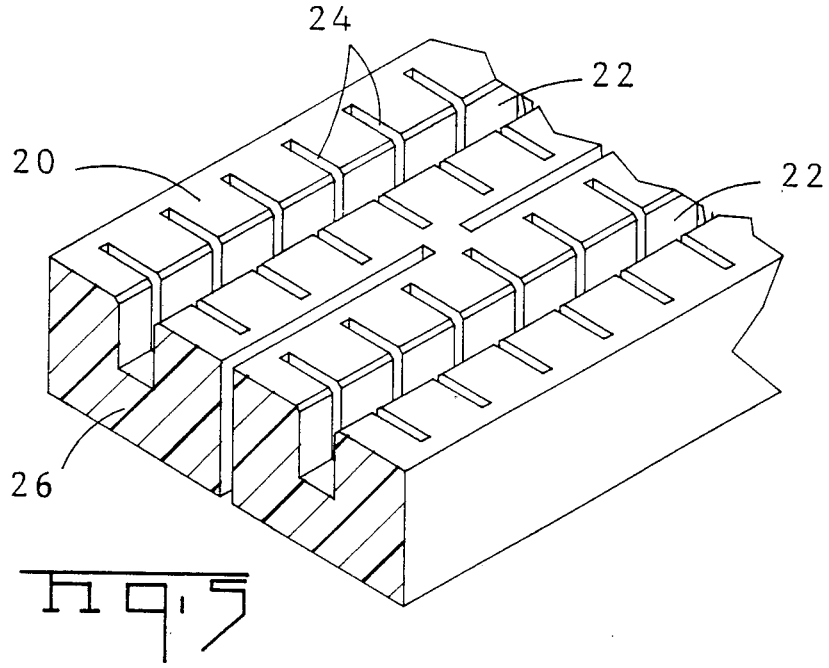
FIG. 5 is a perspective view of a portion of the center of the insulative housing, which is partially in section to show the internal configuration of the housing between terminal positions.
Figure 6:
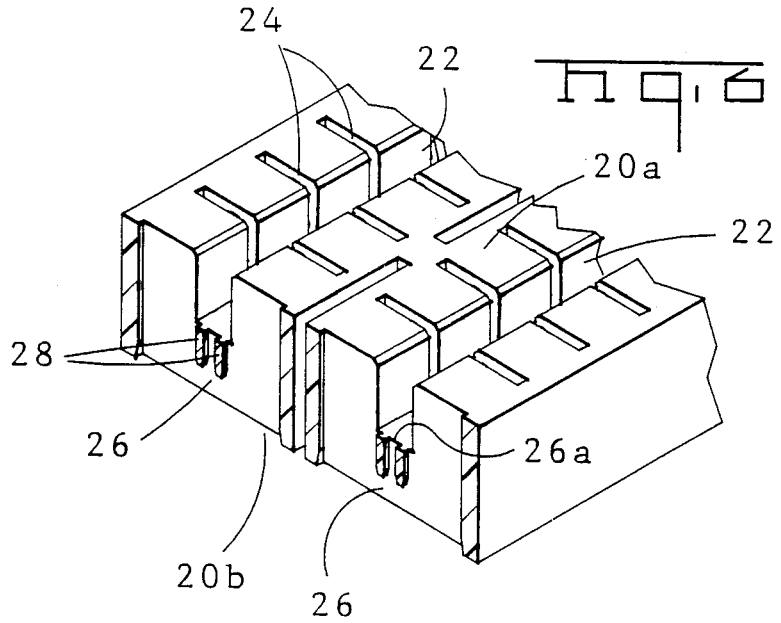
FIG. 6 is a partial view similar to FIG. 5, but showing a section through the housing cavities with the terminals removed.

The insulative housing 20 can be molded of conventional engineering plastic materials suitable for use in electrical connectors. Housing 20 has a generally rectangular central section extending between two panel guide or panel support members 30 located at either end thereof. In the preferred embodiment of this invention, two panel receiving slots 20 extend between the panel guides 30 and open upwardly on the upper face 20*a* in the insulative housing 20. The two slots 22 are parallel. A plurality of cavities 24 also open upwardly on the upper face 20*a* of the insulative housing 20 and communicate with a corresponding panel receiving slot 22 in the dual row connector comprising the preferred embodiment of the invention. Individual cavities 24 communicate only with one of the slots 22. Each of the cavities 24 is open on the top and the bottom of the insulative housing 20 and each cavity 24 extends on opposite sides of the corresponding upwardly open slot 22. A central spine 26 comprises the portion of the insulative housing 20 located below each of the panel receiving slots 22. As shown in FIG. 5, the central spine 26 comprises a solid portion of the insulative housing 20 at positions between cavities 24. The cavities 24 are positioned to intersect the slot 22 with housing ribs 28 comprising that portion of the central spine 26 extending through each cavity. These housing ribs 28 extend downwardly from the lower surface of slots 22, which comprises the upper surface of the central spine 26, and a hole 26*a* is located between the housing ribs 28. Each cavity 24 is open both on the upper face 20*a* of the insulative housing and on the lower face 20*b* . Each cavity 24 extends below the housing ribs 28.

The panel guide or panel support members 32 are located at the opposite ends of the insulative housing 20. Each of these panel guides extends upwardly above the upper face 20*a* of the insulative housing 20 and has an inner face 30*a*. Panel grooves 32 having an open inner ends are inwardly facing and communicate with each panel receiving slot 20. Panel grooves 32 also extend upwardly above the panel receiving slots 22. Panel gripping portions in the form of ridges 34 which comprise constricted portions of the panel receiving grooves 32 are spaced above the open upper end of the panel receiving slot 22. Recesses or relief slots 36 are located adjacent to each of the grooves 32 to define flexible walls 38. These flexible walls are joined as part of the panel support members 30 in the preferred embodiment of this invention. A central pocket 40 is located along the lower end of the panel support members 30 in the preferred embodiment of this invention, and the relief slots 36 in the vicinity of ridges 34 extend upwardly from this pocket 40.

Terminals 10 are inserted into corresponding cavities 24 from the bottom of the insulative housing 20. The contact points 12*e* of the opposed beam 12 are spaced apart by a distance less than the width of the central spine within the cavities. In other words, the contact points 12*e* are spaced apart by a distance less than the spacing of the exterior surfaces of the two ribs 28 within the cavities 26. When the terminals 10 are inserted into cavities 12, the opposed beams 12 are deflected outwardly upon engagement with the ribs 28. Continued movement of the terminal into the cavities 26 from below allows the inwardly inclined arms to spring back to their original position so that each inwardly inclined arm 12*b* projects into the slot from opposite sides. In other words, the contact point 12*e* is now positioned within the panel receiving slot 22. The post or barb 16 extending upwardly from the base 14 on terminal 10 is also aligned with the panel receiving slot 22. The upper surface of each post 16 extends above the bottom of the cavity. The post or barb 16 extends into the hole 26*a* located between the two housing ribs 12*b* and the barb secures the corresponding terminal to the central spine 26 by virtue of its engagement with the two ribs 28.

When a circuit panel 4 is inserted into a panel receiving slot 20, the traces, or the contact pads located on the ends of the traces adjacent the edge 4*a* of the circuit panel, engage the downward by extending portion 12*b* of the opposed beams 12 and deflects these downwardly extending inwardly inclined arms 12*b* outwardly. Contact points 12*e* are brought into contact with these traces adjacent the edge 4*a* of the circuit panel. The edge 4*a* of the circuit panel is also juxtaposed to the post so that contact points indeed engage these traces adjacent the edge. Full force wiping between the contacts and trace pads occurs. Such engagement is especially significant when a non-standard single in-line memory module is employed in this socket.

The panel support members 30 are also configured to support and stabilize especially tall single in-line memory modules. As the circuit panel is inserted into the grooves 32, aligned with the panel receiving slots 20, the flexible walls 38 are deflected when the ridges, forming a constricted portion 34, engage the sides of the circuit panel 4. These ridges serve to both align and secure the circuit panel within the socket 2.

Figure 7:
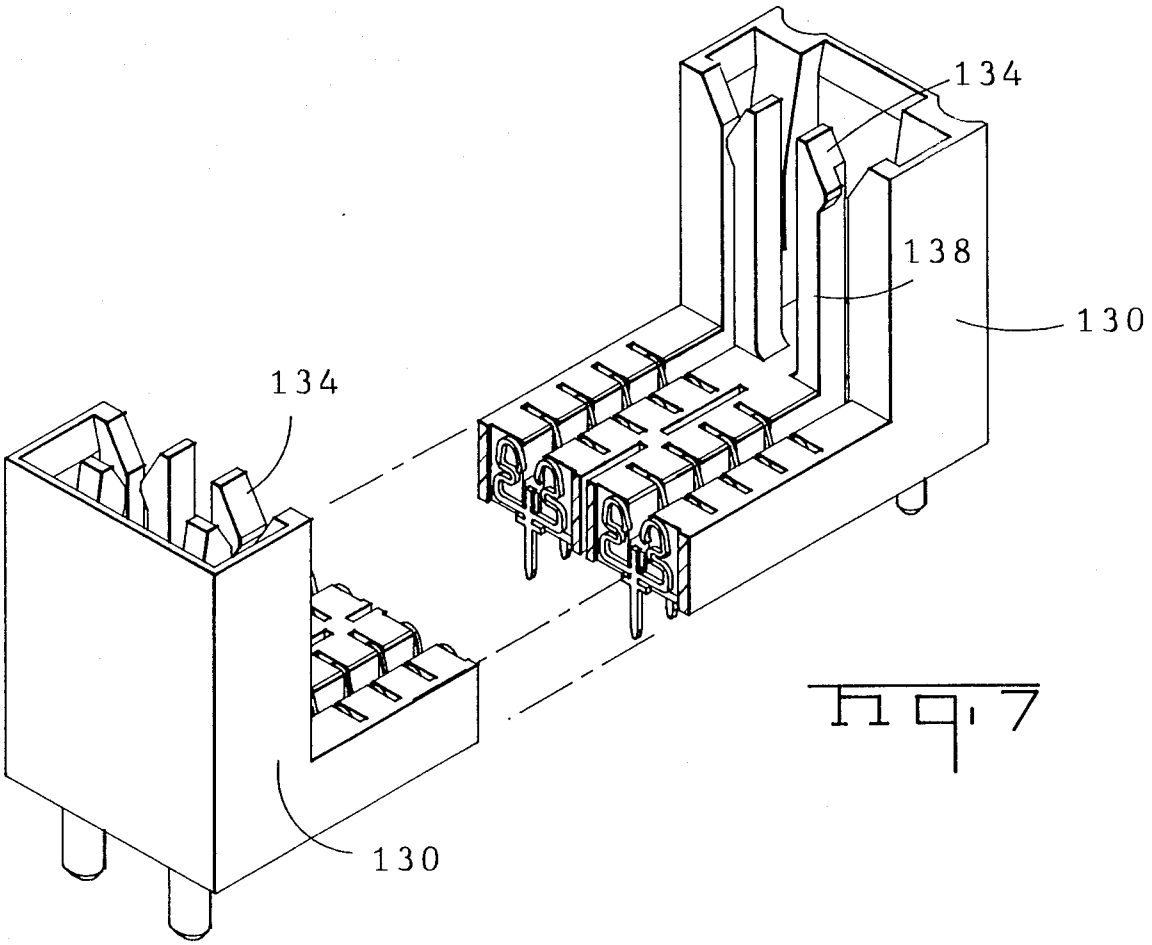
FIG. 7 is a alternate embodiment of the invention showing the same terminal configuration but a different panel support configuration.

As shown in FIG. 7, an alternate panel support guide configuration 130 can be employed with cantilever beams 138 having a panel gripping protrusion 134 adjacent their upper ends. FIG. 7 therefore illustrates that terminals 10 can be employed in other configurations and are not dependant upon the use with the panel support guides 30 comprising the preferred embodiment of this invention. Therefore, it would be clear to one of ordinary skill in the art that the instant invention can be employed in differing configurations and the following claims are not limited to the precise embodiment depicted as the preferred embodiment of this invention or the embodiment comprising the alternate embodiment of FIG. 7.

We claim:

1. A terminal for use in establishing electrical contact with traces on at least one side of a circuit panel, comprising a member edge stamped from a spring meal blank, the terminal having opposed spaced apart beams extending upwardly from a base between the beams, the beams being deflectable upon insertion of a circuit panel therebetween, each beam having an upwardly extending portion connected to the base and a downwardly extending potion extending from the top of the upwardly extending portion, the upwardly extending portions each having an inwardly extending U-shaped loop section between the base and the downwardly extending portion.

2. The terminal of claim 1 wherein the portion of the upwardly extending portion above the loop section is inclined inwardly.

3. The terminal of claim 2 wherein the downwardly extending portion diverges from the inwardly inclined portion of the upwardly extending portion.

4. The terminal of claim 3 wherein a contact point comprising the innermost extent of the downwardly extending portion is located adjacent the end of each beam.

5. The terminal of claim 2 wherein the loop section is located below the downwardly extending portion.

6. The terminal of claim 1 wherein the terminal has a barb extending upwardly from the base, between the two opposed beams.

7. The terminal of claim 6 wherein the top of the barb has substantially the same elevation as the loop sections.

8. The terminal of claim 7 wherein a downwardly extending contact tail extends from the bottom of the base.

9. The terminal of claim 8 wherein the contact tail is aligned with the barb.

10. The terminal of claim 1 wherein the loop section is positioned so that the majority of the deflection of the terminal occurs in the loop section, the base, and the portion of the terminal between the base and the loop section.

11. An electrical connector for use in establishing electrical contact adjacent the edge of traces on at least one side of a circuit panel, the connector comprising:

a plurality of terminals, each having opposed beams with inwardly inclined arms extending downwardly from the top of the beams;

an insulative housing having at least one upwardly open slot and a plurality of upwardly open cavities communicating with the slot, the terminals being positioned in the cavities with the inwardly inclined arms projecting into the slot from opposite sides, contact points being located adjacent the lower end of each inwardly inclined arm; and a post on each terminal aligned with the slot, the upper surface of the post extending above the bottom of each cavity and being located below the contact points of each arm, whereby the circuit panel can be inserted into the slot with an edge of the circuit panel juxtaposed to the post so that the contact points engage the traces adJacent the edge thereof.

12. The electrical connector of claim 11 wherein the post comprises a member projecting upwardly from a base between the opposed beams.

13. The electrical connector of claim 12 wherein the post is received within a central housing spine located between cavities on opposite sides of the corresponding slot.

14. The electrical connector of claim 13 wherein the upwardly projecting post comprises a barb securing the corresponding terminal to the central spine.

15. The electrical connector of claim 14 wherein the cavities are open on the top and the bottom on opposite sides of the upwardly open slot, the spine including a pair of housing ribs in each cavity, each terminal post being secured between the two ribs in the corresponding cavity.

16. The electrical connector of claim 11 wherein each opposed beam has an inwardly extending loop section adjacent the post.

17. The electrical connector of claim 11 further comprising panel support members located at opposite ends of the insulative housing, the panel support members each including inwardly facing grooves communicating with each slot and extending upwardly from the slot, each groove including a panel gripping portion spaced above the open upper end of the slot.

18. The electrical connector of claim 17 wherein relief slots are located on opposite sides of the grooves to define flexible walls on opposite sides of the grooves.

19. The electrical connector of claim 18 wherein the panel gripping portion comprises ridges extending from flexible walls.

20. The electrical connector of claim 11 wherein contact points of opposed beams are spaced apart by a distance less than the local width of the central spine, opposed beams being outwardly deflectable so that the opposed beams can be inserted into the housing from the bottom of the insulative housing.

21. The electrical connector of claim 20 wherein the opposed beams of each terminal includes a loop section extending inwardly at least partially above the upper end of the barb.

22. An electrical connector for use in establishing electrical contact adjacent the edge of traces on at least one side of a circuit panel, the connector comprising:

a plurality of terminals, each having opposed beams with inwardly inclined arms;

an insulative housing having at least one upwardly open slot and a plurality of upwardly open cavities communicating with the slot, the terminals being positioned in the cavities with the inwardly inclined arms projecting into the slot from opposite sides, contact points being located adjacent the lower end of each inwardly inclined arm;

panel support members located at opposite ends of the insulative housing, the panel support members each including inwardly facing grooves communicating with each slot and extending above the slot, each groove including a panel gripping means spaced above the open upper end of the slot; and a relief slot located adjacent each of the grooves to define a flexible wall on one side of each groove, the flexible walls being joined as part of the panel support members at each end of the flexible walls, the panel gripping means being located on the flexible walls, whereby the circuit panel can be inserted into the slot so that the contact points engage the traces adjacent the edge thereof.

23. The electrical connector of claim 22 wherein the terminals are insertable into the insulative housing from below.

24. The electrical connector of claim 22 wherein the insulative housing has two parallel upwardly open panel receiving slots and the panel support members have an open pocket between flexible walls between the two panel receiving slots, the relief slots adjacent each panel gripping means on each flexible wall comprising an extension of the pocket.

25. A terminal for use in establishing electrical contact with traces on at least one side of a circuit panel, comprising a member edge stamped from a spring metal blank, the terminal having opposed beams extending upwardly from a base between the beams, the beams being deflectable upon insertion of a circuit panel therebetween, each beam having an upwardly extending portion connected to the base and a downwardly extending portion extending from the top of the upwardly extending portion, the upwardly extending portions each having an inwardly extending U-shaped loop section between the base and the downwardly extending portion, the downwardly extending portions being spaced apart and each loop section being spaced from the adjacent downwardly extending portion.

* * * * *

UNITED STATES PATENT AND TRADEMARK OFFICE

CERTIFICATE OF CORRECTION

PATENT NO. : 4,973,270

DATED : November 27, 1990

INVENTOR(S) : Timothy B. Billman and Roger L. Thrush

It is certified that error appears in the above-identified patent and that said Letters Patent is hereby corrected as shown below:

Claim 1, line 28, column 6 - delete the word "meal" and insert --metal--.

Signed and Sealed this

Twentieth Day of October, 1992

*Attest:*

DOUGLAS B. COMER

*Attesting Officer*

*Acting Commissioner of Patents and Trademarks*